US008424599B2

(12) United States Patent
Atencio

(10) Patent No.: US 8,424,599 B2
(45) Date of Patent: Apr. 23, 2013

(54) AUTOMATED CLOSED LOOP FLOWBACK AND SEPARATION SYSTEM

(75) Inventor: Don Atencio, Houston, TX (US)

(73) Assignee: Fracmaster, LLC, Houston, TX (US)

( * ) Notice: Subject to any disclaimer, the term of this patent is extended or adjusted under 35 U.S.C. 154(b) by 297 days.

(21) Appl. No.: 12/769,239

(22) Filed: Apr. 28, 2010

(65) Prior Publication Data

US 2010/0206560 A1 Aug. 19, 2010

Related U.S. Application Data

(60) Continuation-in-part of application No. 12/609,252, filed on Oct. 30, 2009, which is a division of application No. 11/731,382, filed on Mar. 29, 2007, now Pat. No. 7,621, 324.

(60) Provisional application No. 61/173,768, filed on Apr. 29, 2009, provisional application No. 61/174,127, filed on Apr. 30, 2009.

(51) Int. Cl.
*E21B 43/34* (2006.01)
*E21B 43/12* (2006.01)

(52) U.S. Cl.
USPC ..... 166/250.15; 166/379

(58) Field of Classification Search ..... 166/91.1, 166/53, 75.12, 95.1, 373, 379, 250.15
See application file for complete search history.

(56) References Cited

U.S. PATENT DOCUMENTS 1,699,227 A * 1/1929 Craddock ..... 137/536
3,526,276 A * 9/1970 Haberthur et al. ..... 166/52
3,970,143 A * 7/1976 Thrash ..... 166/53
4,083,409 A 4/1978 Barrington
4,161,215 A 7/1979 Bourne et al.
4,898,236 A 2/1990 Sask
5,070,457 A 12/1991 Poulsen
5,330,005 A 7/1994 Card et al.
5,431,224 A 7/1995 Laali
5,439,055 A 8/1995 Card et al.
5,501,275 A 3/1996 Card et al.
5,667,012 A 9/1997 Hoover et al.
5,775,425 A 7/1998 Weaver et al.
5,787,986 A 8/1998 Weaver et al.
(Continued)

OTHER PUBLICATIONS http://www.ipsadvantage.com/production_testing.html, copyright 2012.

*Primary Examiner* — Thomas Beach
*Assistant Examiner* — James Sayre
(74) *Attorney, Agent, or Firm* — Dennis F. Armijo

(57) ABSTRACT

An automated closed loop flowback and separation system that allows automated control and remote operation of a flowback operation from a safe distance without any fluid or gas release to the atmosphere. Four-phase separation tanks allow the transport gas, well bore cuttings, produced oil, and produced water to be automatically separated and transported through process piping for reuse or sale, eliminating the need for auxiliary equipment. Flow measurement instruments, pressure transmitters, and level transmitters work in conjunction with an automated blast choke to send data to a programmable logic controller for use in calculating the erosion status of the choke restriction and adjusting the choke to compensate. The programmable logic controller works with a touchscreen or similar human-machine interface to allow remote monitoring and control or automated control of the system. The automated blast choke can vary the choke restriction opening based on the pressure differential and flow rate conditions.

22 Claims, 5 Drawing Sheets

U.S. PATENT DOCUMENTS 5,833,000 A 11/1998 Weaver et al.
5,839,510 A 11/1998 Weaver et al.
5,853,048 A 12/1998 Weaver et al.
5,871,049 A 2/1999 Weaver et al.
5,878,817 A * 3/1999 Stastka ..... 166/372
6,047,772 A 4/2000 Weaver et al.
6,172,011 B1 1/2001 Card et al.
6,209,643 B1 4/2001 Nguyen
6,554,064 B1 4/2003 Restarick et al.
6,626,241 B2 9/2003 Nguyen
6,659,179 B2 12/2003 Nguyen
6,776,239 B2 8/2004 Eslinger et al.
6,793,018 B2 9/2004 Dawson et al.
6,983,801 B2 1/2006 Dawson et al.
6,988,552 B2 1/2006 Wilson et al.
6,991,034 B2 * 1/2006 Wilde ..... 166/250.15
7,086,460 B2 8/2006 Nguyen et al.
7,105,716 B2 9/2006 Baratian et al.
7,621,324 B2 11/2009 Atencio
2002/0027002 A1 3/2002 Carmody et al.
2002/0134549 A1 9/2002 Marangoni et al.
2004/0020860 A1 * 2/2004 Schmigel et al. ..... 210/744
2006/0070735 A1 * 4/2006 Guerra et al. ..... 166/267

* cited by examiner

AUTOMATED CLOSED LOOP FLOWBACK AND SEPARATION SYSTEM

CROSS-REFERENCE TO RELATED APPLICATIONS

This application claims priority to Provisional Application Ser. No. 61/173,768, filed on Apr. 29, 2009 entitled "Flowback Tank System" and also to Provisional Application Ser. No. 61/174,127, filed on Apr. 30, 2009, entitled "Flowback Tank System" and is a continuation-in-part to co-pending patent application Ser. No. 12/609,252, entitled "Automated Flowback and Information System" filed on Oct. 30, 2009, which is a Divisional Patent Application of Ser. No. 11/731,382 filed Mar. 29, 2007, now U.S. Pat. No. 7,621,324, entitled "Automated Flowback and Information System", all owned by the Applicant hereof and hereby expressly incorporated by reference herein.

BACKGROUND OF THE INVENTION

1. Field of the Invention (Technical Field)

The presently claimed invention relates to oil and gas well servicing and more particularly to a flowback and separation system for controlling the flow of fluids into the separation system, the separation system provides for separation of gas, well bore cuttings, produced oil, and produced water to be automatically separated. The gas can be sold or recirculated for reuse in the flowback operation.

2. Background Art

In a traditional prior art flowback operation, the pressurized transport gas, well cuttings, produced oil, and produced water are brought back to the surface into an open top tank. A mist of produced oil and water is produced by the nozzle effect of the fluid entering the tank and carried into the atmosphere causing environmental release complications. Additionally, if natural gas is used as the transport gas, the gas is released into the atmosphere, or diverted to a flare stack.

An alternative, newer method of flowback is conducted through the use of a high pressure "sandbuster" vessel used to remove the solid products carried up from the well bore from the process stream followed by a small volume pressure vessel used to separate the gas phase from the liquid phase. The produced water and produced oil liquid mixture is then emptied through process piping to a holding tank. The gas phase is released through process piping to a flare stack or reused for the well servicing operation. This system can accommodate a closed loop flowback operation; however, it is limited in the range of process conditions it can accommodate, does not provide the data collection and automated correction of the blast choke, does not allow for separation of the oil and water liquid phases, and does not incorporate any significant automation.

The above approach uses a small volume pressure vessel. Manufacturing a large vessel capable of withstanding high pressure is difficult and expensive. The small volume pressure vessel cannot handle a large slug of liquid and cannot separate the liquid into the oil and water phases in the vessel. This limitation creates additional expense for additional equipment and tanks on site. The additional equipment also adds an additional safety hazard associated with the congestion on the well location.

In addition to the approaches taken above, others have attempted to monitor the erosion status of the restriction choke by measuring the pressure upstream and downstream of the restriction choke and charting this pressure trend on a pen chart recorder. The trend is observed by a technician and compared to pre-determined charts to make a judgment determination to change the choke restriction. No automation is used to mitigate the safety hazards associated with human interaction with the system. An example of the prior art systems as discussed above can be found at:

http://www.ipsadvantage.com/production_testing.html

There are significant disadvantages of the aforementioned open tank flowback systems. These include environmental release associated with the mist of fluid exiting the top of the tank, waste and potential environmental release associated with venting the transport gas to the flare stack, the inability to monitor the erosion status of the choke restriction or to change the choke restriction and to separate the process fluids, in real-time.

The disadvantages of the small volume pressure vessel flowback systems include: waste and potential environmental release associated with venting the transport gas to the flare stack, inability to monitor the erosion status of the choke restriction, reliance on the judgment of the technician on when to change or check the choke restriction, the small volume pressure vessel can "slug" or be overtaken by liquid when a large slug of liquid surges through the wellbore to the surface. The small volume tank cannot empty fast enough to accommodate the sudden intake of liquid, is unable to open and close valves to divert the process fluid flow through an automated system to accommodate the changing flow conditions, unable to monitor from a safe distance or remotely monitor the status of the flowback operation, and unable to adjust an automatic choke using inputs from an automation system, in real-time. The prior art devices are unable to incorporate automated safety shut down or ESD systems by monitoring data being transmitted by sensors and predetermined programmed safety perimeters by interpreting the data being monitored. They are also unable to automatically divert flow to an alternate blast barrel or blast choke from data being monitored.

State of the art approaches have failed to solve the problem through lack of automation, limitations on the range of flow parameters, and inability to fully separate process fluids. The inability to accurately determine the erosion status of the choke restriction can result in safety hazards and potential environmental release. Additionally, the lack of automation prevents these approaches from automatically diverting flow to separate choke restriction lines or tanks, depending on the flow conditions. The lack of automation also prevents these approaches from monitoring and controlling the system from a safe distance. These existing systems do not provide the ability to modify or remotely monitor the choke setting through the use of an automatically adjustable blast choke integrated into the system. Additionally, existing systems have failed to address the numerous advantages associated with the ability to remotely monitor or automatically control the choke setting, providing a much higher level of control and safety over the flowback operation. Finally, existing systems have failed to address the problems caused by their lack of range ability. The existing systems fail to work when the well bore sends a large slug of liquid to the surface, causing the existing small volume tanks to flood out.

SUMMARY OF THE INVENTION

Disclosure of the Invention

The presently claimed invention solves the problems discussed above and overcomes the shortcomings of the prior art with the unique features provided in the appended claims.

The treating or stimulation procedures associated with a controlled flowback of an oil or natural gas well require nitrogen, air, or natural gas to be used as a pressurized gas for transporting the treating and stimulation fluids used during these operations from the well bore back to the surface. The pressurized transport gas is typically vented to the atmosphere or to a flare once it is returned to the surface. Nitrogen is expensive to purchase or extract from the atmosphere for use in the operation. Air presents a safety hazard due to the risk of introducing a combustible mixture into the well bore. The use of natural gas requires purchasing the gas and then burning it in a flare at the end of the operation, resulting in a release to the atmosphere. By incorporating an automated, pressurized tank separation system the pressurized transport gas can be separated at the surface from the well fluids and reused in the controlled flowback operation or sent to a sales line. The incorporated four-phase separation tank(s) can separate the sand and solid well cuttings, produced water, produced oil, and gas through a combination of a straight section of pre-run piping, a unique tank inlet flow conditioner, a pressure tank designed to take advantage of the different densities of each phase of the process fluid, and an outlet mist eliminator. The separated phases are then automatically emptied from the tank through process piping a series of sensors and valves for sale, disposal, or reuse. The automation achieved through instrumentation and programming allows the above procedures to occur with minimal human interaction and exposure to the safety hazards associated with high pressure piping.

Additionally, the process of controlling the rate of the flowback presents safety hazards due to the difficulty of monitoring the impact of the abrasive and corrosive fluids on the choke restriction and process piping. The potential for a washout of the choke or process piping presents risk for injury and environmental release. The choke restriction must start with a very small diameter and gradually be increased in diameter to control the rate of flowback from the well. The existing process of changing the choke restriction involves manually closing valves in a choke and kill manifold to allow the bypass of the choke restriction while it is manually changed. The new design will integrate an automatically controlled adjustable blast choke mechanism. The blast choke will be incorporated into the separation tank inlet flow conditioner to form a unique flowback system. The capability of the blast choke to communicate choke wear is combined with the automatically adjustable choke to adjust the choke through remote manual operation or automatically through predetermined algorithms. Flow measurement transmitters, level transmitters, and sensor transmitters are incorporated into the tank separation system to measure the pressure and volume of gas, produced oil, and produced water. The values are transmitted to an incorporated programmable logic controller (PLC) with an integrated touch-screen human-machine interface (HMI). The PLC uses the flow and pressure data from the tank along with the pressure differential data from the blast barrel transmitters to calculate and record equivalent choke diameters through proprietary algorithms. The HMI allows the user to quickly and visually set-up and control the system from a safe distance. The automated combination of the mechanisms above, form a unique automated closed loop flowback and separation system.

There are several advantages of the presently claimed invention to the state of the art systems. One advantage of the invention is the ability to calculate an equivalent choke diameter and to manually, automatically, or remotely adjust the choke diameter to adjust for wear due to erosion without having to open or close any valves to divert process flow. Another advantage is that the system automatically adjusts the control valves to accommodate large slugs of liquid and accommodate a closed loop flowback operation with no release to the environment. The control valves can be automatically or remotely controlled so personnel do not have to be exposed to high pressure piping. Yet another advantage is the four-phase separation system for the process stream. Another advantage of the system is the ability to communicate historical and current process data to a remote location and control the system from the remote location.

Other objects, advantages and novel features, and further scope of applicability of the presently claimed invention will be set forth in part in the detailed description to follow, taken in conjunction with the accompanying drawings, and in part will become apparent to those skilled in the art upon examination of the following, or may be learned by practice of the claimed invention. The objects and advantages of the claimed invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

DESCRIPTION OF THE PREFERRED EMBODIMENTS

Best Modes for Carrying Out the Invention

A choke or choke restriction is defined as a component or method of restricting flow. A choked flow condition is a condition, that due to the size of the restriction, no matter how much you increase the upstream pressure or decrease the downstream pressure, no additional volume of fluid can flow. As used for this disclosure, a choke restriction is used to prevent the pressure in the well bore from wildly flowing free and ruining the well. The well is brought "on-line" in a slow controlled manner by slowly increasing the diameter of the choke restriction. When a choke restriction is used, the flow regime exiting the choke restriction is highly turbulent, causing erosion of the choke restriction and downstream components. By monitoring the pressure differential across the choke, and comparing to the flow rate measured by the outlet flow meters, one can calculate an equivalent choke diameter and determine how much it has eroded. A sensor transmitter can be a pressure transducer or other well known pressure measuring and sending device. This information can be used with computer algorithms to automate an adjustable choke. A sandbuster is defined as a device that provides primary separation of sand and solid matter from the process flow. Automated valves are defined as devices that allow the opening, closing, blocking, and diverting of fluid flow based on algorithms from a programmable logic controller (PLC) or from other mechanical or pneumatic signals. A blast choke barrel integrates an automated adjustable choke with the capability of the blast barrel to transmit pressure data. A blast barrel is defined as an apparatus for containing and controlling high pressure fluids from a wellbore in a flowback system and is described in U.S. Pat. No. 7,621,324. When a choke restriction is used, the flow regime exiting the choke restriction is highly turbulent causing erosion of the choke restriction and downstream components. By monitoring the pressure differential across the choke, and comparing to the flow rate measured by the outlet flow meters, one can calculate an equivalent choke diameter and determine how much it has eroded. This information can be used with computer algorithms to automate an adjustable choke. An automated four-phase separation tank(s) is defined as a system that separates and distributes the solid matter, produced oil, produced water, and gas into separate phases.

Figure 1A:
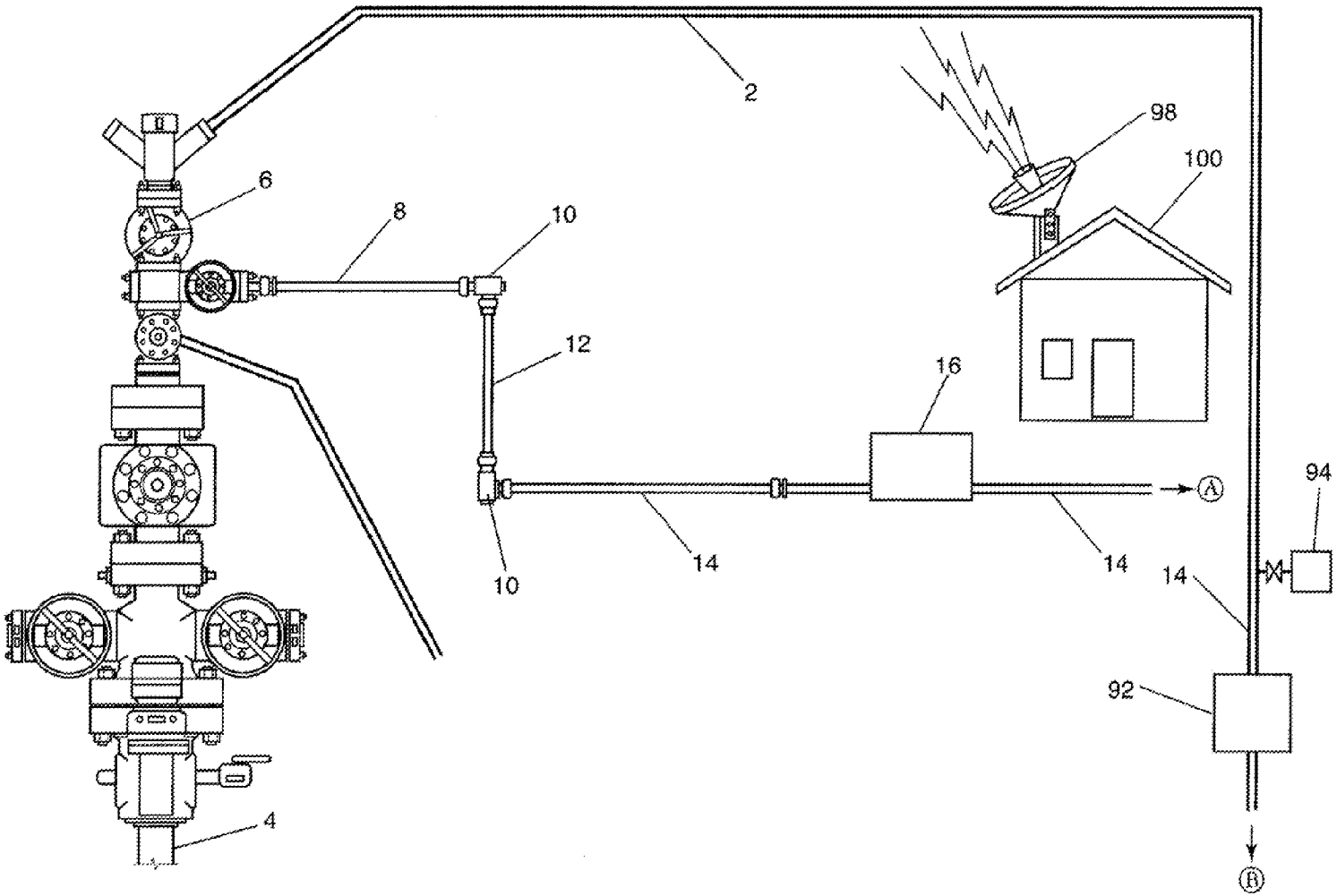
FIGS. 1A, 1B and 1C are a segmented diagram of the automated closed loop flowback and separation system.
Figure 1B:
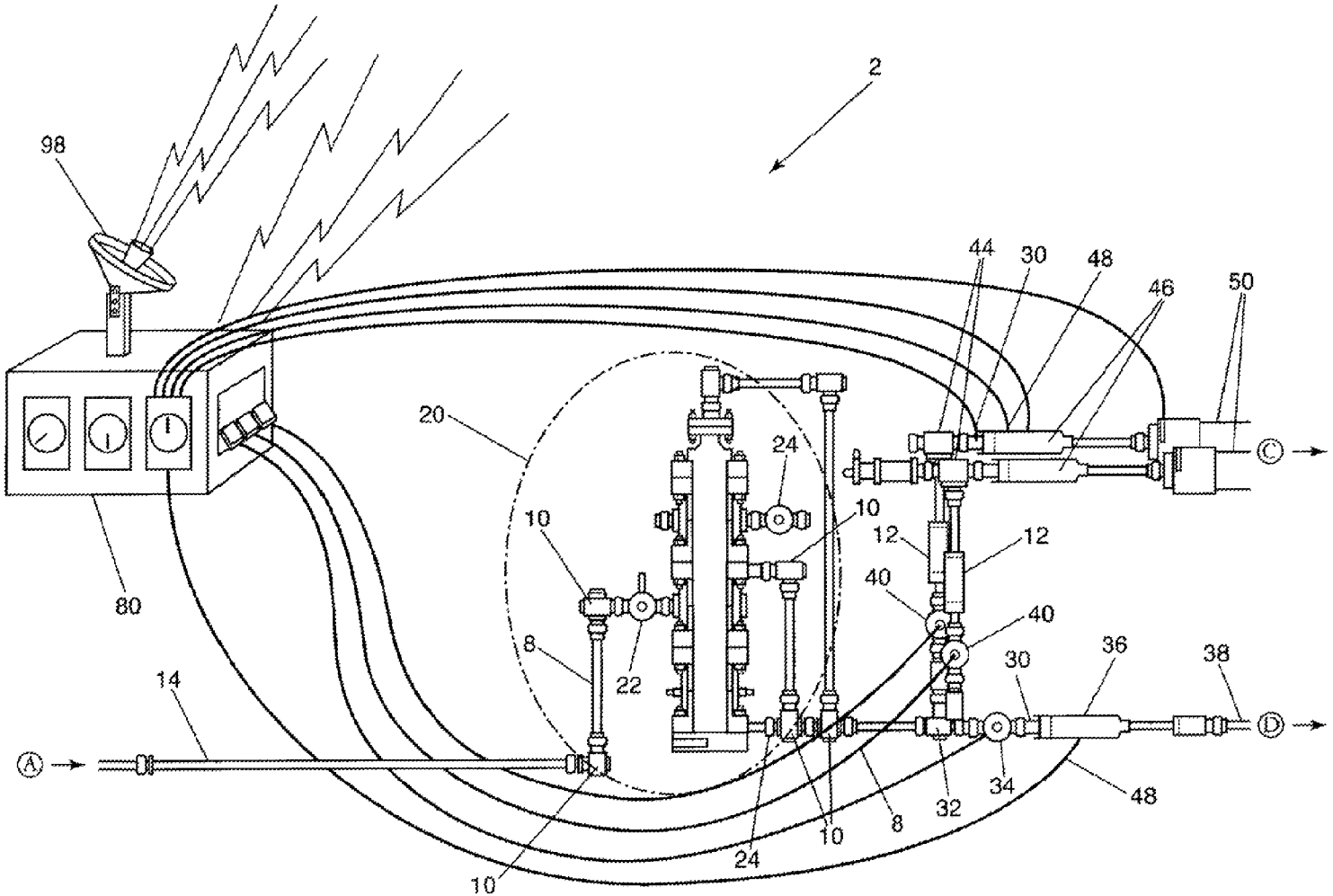
Figure 1C:
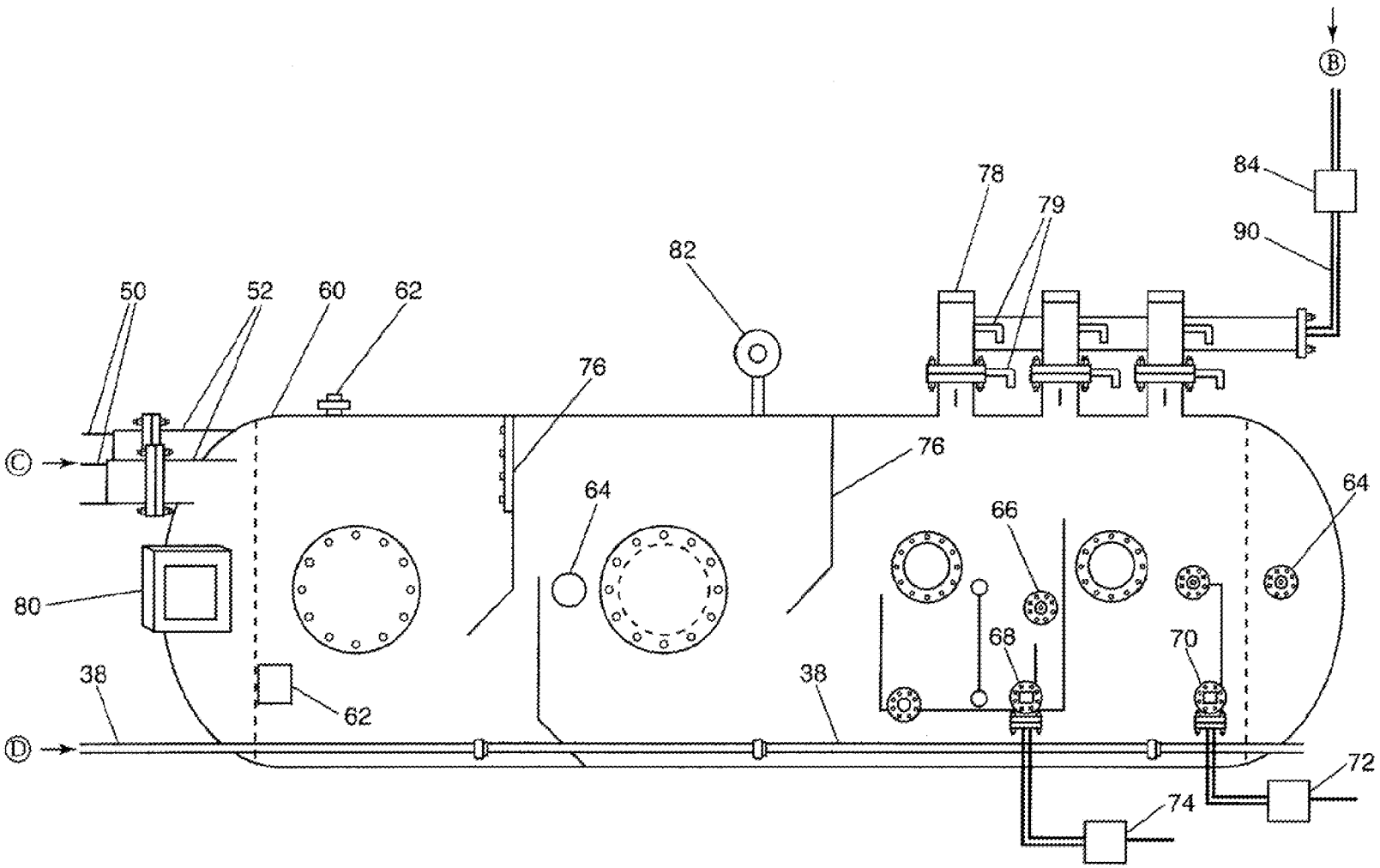

As shown in FIGS. 1A, 1B and 1C, flowback system 2 includes a frac tree or flowback tree 6 which includes a series of valves that can be of various sizes and pressure ratings used in opening and closing well 4 before and after fracturing stimulation and flowback clean up of a well. High-pressure flowlines or pup joints 8 of various sizes and pressure ratings are installed in a horizontal position, and vary in length based on the application. High pressure flow lines 14 are typically attached or installed by a connection, known in the oil industry, as a hammer union (not shown). These connections are typically made by rotating the wingnut portion of the union onto the threaded portion of the union, and connecting to an integral union cushion elbow 10 or targeted tee. Integral union cushion elbow 10 is designed to absorb and deflect the products being carried by the internal flow of the wellbore during clean out. Integral union cushion elbow 10 is connected to a first end of a pup joint or expansion sub 12 and a second integral union cushion elbow 10 is connected to the second end of a pup joint or expansion sub 12. Connected to second integral union cushion elbow 10 are high-pressure pup joint flowlines 14, which can be of various sizes and pressure ratings. High pressure flowlines 14 are installed and secured by adjustable cement blocks 16, which are designed to restrain movement of the high pressure flowlines in a horizontal position. High pressure flowlines 14 or pup joints 8 vary in length and quantity requirements, and are based on distance and application.

Figure 3:
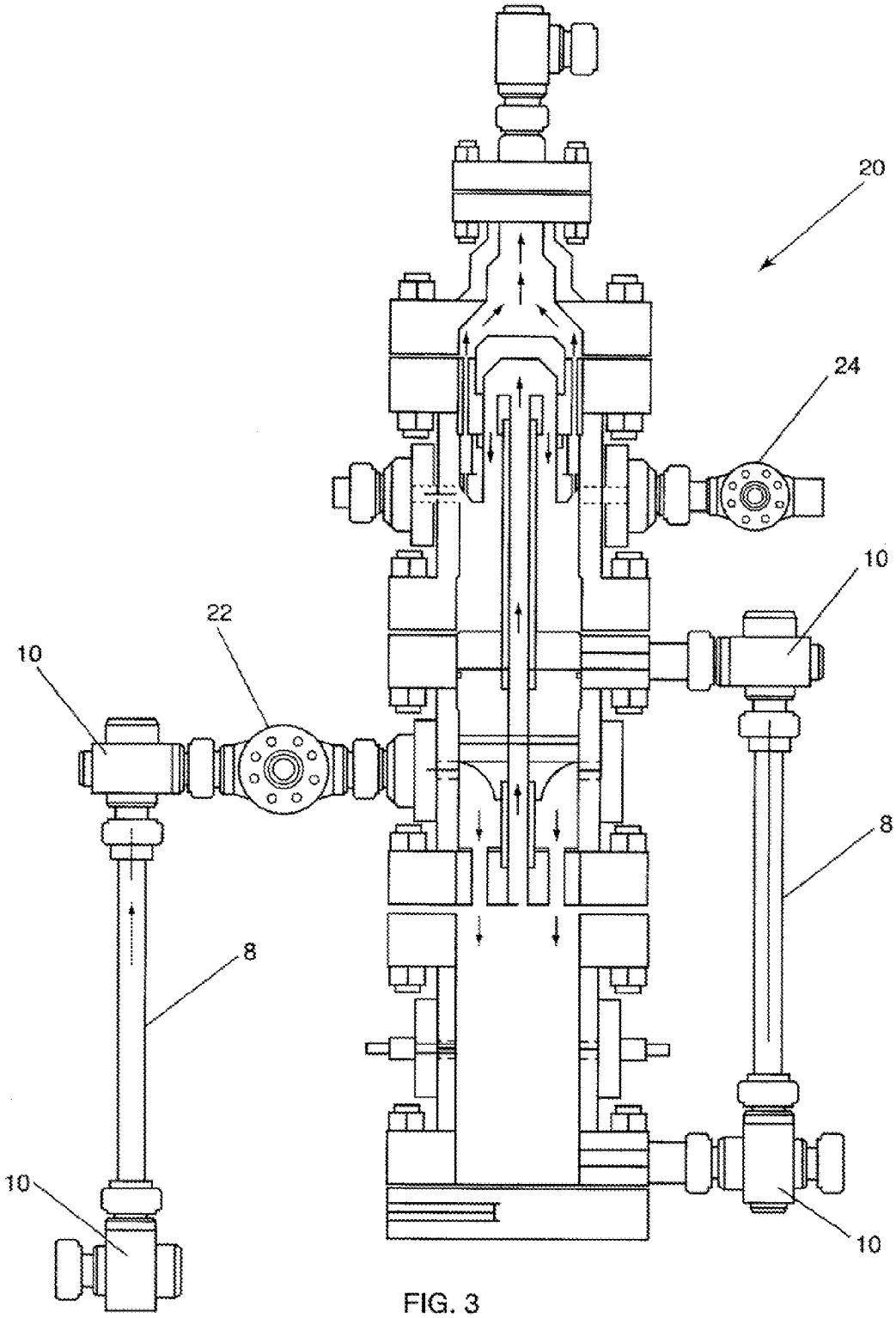
FIG. 3 is a blown up depiction of the sandbuster of FIG. 1B.

High pressure flow lines 14 are routed to a high pressure sandbuster 20, a blown up version shown in FIG. 3, is used to remove the sand and other solid material from the flow stream. High pressure flow lines 14 enter high pressure sandbuster 20 through a vertical pup joint 8 and union cushion elbows 10 at high pressure sandbuster inlet valve 22, the flow stream travels through a torturous path in high pressure sandbuster 20 and exits out the top of high pressure sandbuster 20. High pressure sandbuster 20 is equipped with sand cleanout valves 24 at the sand collection areas for emptying of the separated sand and solid material. High pressure flow lines 14 combined with union cushion elbows 10, and pup joints 8 route from high pressure sandbuster 20 to inlet blast choke barrel manifold assembly 30 at the inlet to closed loop separation tank 60.

Figure 2:
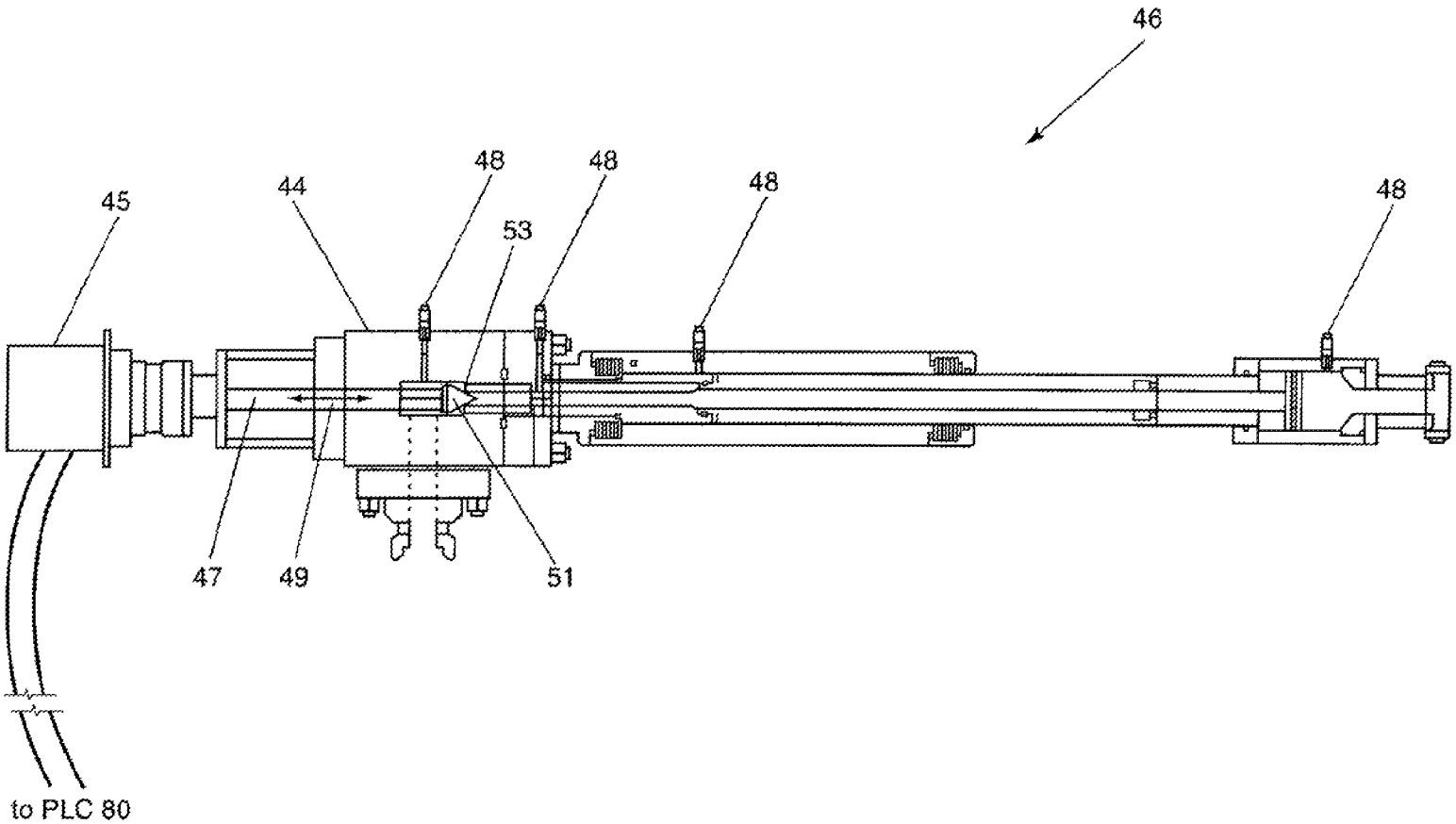
FIG. 2 is a diagram of the automated blast choke barrel showing the automated or manually adjustable blast choke attached to the blast barrel and sensor transmitters.

High pressure flowlines 14 are attached by a hammer union to a series of union tees 32. Union tees 32 divert the flow into two separate tank inlet flow conditioner chambers 50 and to a high pressure bypass line 38 through an automated bypass valve 34 and a bypass blastbarrel 36. Automated bypass valve 34 is controlled by system programmable logic controller (PLC) 80 based on the flow condition data transmitted by the blast choke barrel sensor transmitters 48, water flow meter 72 and oil flow meter 74. Automated tank inlet valve 40 attaches to each vertical coupling or expansion sub 12 and used to close, block, or divert flow to bypass line 38 or blast choke barrel 46, as shown in FIG. 2. One automated tank inlet automated valve 40 can be closed to direct all flow to other tank inlet flow conditioner chambers 50, or both tank inlet automated valves 40 can be opened if the flow conditions dictate the necessity for additional flow capacity into four-phase closed loop separation tank 60. Vertically installed expansion subs 12 route process flow through blast choke barrel 46 to inlet flow conditioner chambers 50. Blast choke barrel 46 is designed with an integral ninety degree (90°) automated blast choke 44 to restrict the flow, drop the pressure, and direct the flow back to the horizontal direction for flow conditioning in inlet flow conditioner chambers 50. Blast choke barrel 46 uses sensor transmitters 48 to measure the pressure differential across automated choke 44 and transmit the data to PLC 80 for use in algorithms to control setting of blast choke 44. The setting of the flow through blast choke 44 is provided by motor 45 which drives stem choke 47 in a forward or reverse direction 49, which in turn drives tapered pin 51 towards or away from choke insert 53. Motor 45 can be an electric or pneumatically driven device. The PLC algorithms control automated blast choke 44 setting and open or closed state of automated tank inlet valves 40 and automated bypass valve 34 based in part on blast choke sensor transmitter 48 data. Blast choke barrels 46 are attached to inlet flow conditioner chambers 50 of the tank. The flow conditioner chambers prepare the turbulent flow regime exiting blast choke barrel 46 for pre-separation at tank inlet nozzles 52.

The process flow enters automated four-phase closed loop separation tank 60 which separates the remaining solid material, produced water, produced oil, and gas through traditional baffle and gravity separation methods. Level instruments 62 monitor and transmit the level of the solid material to PLC 80, which can alarm a technician for high sand level, or record historical data for future reference. Water level transmitters 64 and an oil level transmitter 66 monitor and transmit the respective levels of each liquid. The data is used to control an oil dump valve 68 and water dump valve 70 which empty each liquid through an oil flow meter 74 and a water flow meter 72 to a sales line (not shown) or holding tank (not shown) based on a specified liquid level. The data from each flow meter 72, 74 is transmitted to PLC 80 for use in an algorithm to control automated inlet valves 40 and automated bypass valve 34. Flow meter data 72, 74 is also recorded and used for future reference.

The separated gas stream travels through a series of baffles 76 and outlet mist eliminators 78 in automated four-phase closed loop separation tank 60. Optional valves 79 can be used for the outlet stream for individually shutting off the stream to each mist eliminator 78 for maintenance or replacement. The gas stream exits the top of automated four-phase closed loop separation vessel 60 through a gas flow meter 84. Gas flow meter 84 transmits data to PLC 80 for use in algorithms to control automated tank inlet valves 40 and automated bypass valves 34. The data from each of three flow meters 72, 74, 84 is also used in the algorithms to control blast choke 44 setting. The separated gas stream is routed through low pressure piping 90 to treating or stimulation equipment 92. The gas stream can then be pressurized in treating or stimulation equipment 92 and transported through high pressure piping 14 back to frac tee 6 or routed to a sales meter 94 for sale to a pipeline.

Tank sensor transmitter 82 located on automated four-phase closed loop separation tank 60 transmits data to PLC 80. When a high pressure condition is transmitted to PLC 80 automated tank inlet control valves 40 are closed and automated bypass valve is opened 34 to route the high pressure flow condition away from automated four-phase closed loop separation tank 60.

PLC 80 can transmit historical and current process condition, valve positions, and flow rates, liquid levels via a transmitter 98, such as a satellite, mobile device such as cell phone, or radio or other well known methods to a remote location 100 for monitoring or remote control of the system.

Automated control valves 40, 34 operate by attaching an electric, air, or gas powered actuator to the valve. PLC 80 sends an electronic signal which directs the valve actuator to open or close the valve. Limit switches placed on the valve actuator transmit data back to PLC 80 to provide data on the current position of the valve and actuator. PLC 80 receives pressure data from the blast barrel sensor transmitters and flow rate data from the gas and liquid flow meters. PLC 80 is programmed with algorithms to determine if the valves should be opened or closed based on the data from the sensor transmitters and flow meters.

As is shown in FIG. 2, blast choke 44 operates in conjunction with blast choke barrel 46 to adjust the opening of choke restriction 44 based on the pressure differential sensed across choke restriction 44 by blast choke barrel sensor transmitters 48 and the flow rate data from flow meters 72, 74, 84.

Inlet flow conditioner chambers 50 operate to change the turbulent flow exiting the choke restriction into a smooth, laminar flow in preparation for separation in automated four-phase closed loop separation tank 60.

The prior art has focused only on recording the differential pressure trend and comparing to historical trends to determine the erosion on a choke restriction. By uniquely incorporating the flow meters the equivalent choke diameter can be approximated. By using the flow meter data combined with the choke restriction differential pressure and combining with the PLC algorithms the system can be programmed to handle varying process conditions with automated valves. Combining all of the above with a separation tank large enough to handle large liquid slugs (with automated valves to help handle the large liquid slugs) a true closed loop flow back system is designed that can handle a wide range of process conditions The algorithms are comprised of measuring the differential pressure across the choke restriction and approximating a flow rate using proven and documented orifice calculations. The approximated value is then compared to the sum of the flow rates from the outlet flow meters (corrected for pressure) and an equivalent orifice diameter is calculated based on the difference between the approximated flow value and the summed measured flow values. A correction factor is then applied to the equation to account for the variation between a true orifice plate calculation and the approximated value.

Conventional thinking is that the separation tank has to be able to handle the full pressure of the well bore. Since high pressure tanks are difficult and expensive to build the conventional method has used a small tank. By automating the system, the pressure downstream of the choke can be maintained at a lower pressure (due to the choke restriction) without risk of washing out or eroding the choke and over-pressuring the separation tank. This allows for a much larger separation tank, which allows for a true closed-loop flowback system.

Although the claimed invention has been described in detail with particular reference to these preferred embodiments, other embodiments can achieve the same results. Variations and modifications of the presently claimed invention will be obvious to those skilled in the art and it is intended to cover in all such modifications and equivalents. The entire disclosures of all references, applications, patents, and publications cited above, are hereby incorporated by reference.

What is claimed is:

1. A method of separating and controlling the flow of fluids in an oil and gas well system, the method comprising the steps of:

a) routing the flow of fluids to a filter to remove solid materials from the fluid;

b) routing the flow of fluids from the filter to one or more blast choke barrels, each blast choke barrel comprising an outer chamber; and a primary barrelhead adjustably affixed inside the outer chamber, wherein the primary barrelhead comprises at least one nipple, at least one choke, wherein the at least one nipple and at least one choke are exposed for maintenance by rotating the chamber from the primary barrelhead without dismantling the at least one blast barrel from connected high pressure lines;

c) monitoring fluid pressures in predetermined locations by sensors in the one or more blast choke barrels;

d) automatically adjusting the flow of fluids through the one or more blast choke barrels by a controller based on the monitored pressures;

e) routing the flow of fluids from the one or more blast choke barrels to a closed loop separation tank; and f) separating the flow of fluids into a remaining solid material, produced water, produced oil, and gas.

2. The method of claim 1 wherein the step of adjusting the flow further comprises the step of monitoring levels of the remaining solid material, produced water, produced oil, and gas.

3. The method of claim 1 further comprising the step of diffusing the fluid flow before the separating step.

4. The method of claim 3 wherein the step of diffusing comprises directing the fluid flow through a series of baffles and gravity separation structures.

5. The method of claim 1 wherein the predetermined locations for monitoring pressures comprise at least one first sensor upstream of a fluid choke for automatically adjusting the fluid flow and at least one second sensor downstream of the fluid choke.

6. The method of claim 1 wherein the step of automatically adjusting is made remotely.

7. The method of claim 1 wherein the step of separating comprises separating by a centrifugal, gravitational, or filtration system.

8. The method of claim 1 wherein the step of automatically adjusting the fluid flow comprises controlling a choke valve based on pressure measurements, flow measurements, choke position measurements, and a predetermined calculated flow rate.

9. The method of claim 1 wherein the step of automatically adjusting comprises restricting the fluid flow, reducing of flow pressure, and re-directing the fluid flow in a horizontal direction.

10. The method of claim 1 wherein the step of automatically adjusting comprises driving a tapered pin linearly in a forward and reverse direction towards and away from a choke insert.

11. The method of claim 1 further comprising the step of independently storing the separated remaining solid material, produced water, produced oil, and gas.

12. A system for separating and controlling the flow of fluids in an oil and gas well system, the system comprising:

a filter to remove solid materials from the fluid flow;

one or more blast choke barrels for accepting the fluid flow from the filter, each blast choke barrel comprising an outer chamber; and a primary barrelhead adjustably affixed inside the outer chamber, wherein the primary barrelhead comprises at least one nipple, at least one choke, wherein the at least one nipple and at least one choke are exposed for maintenance by rotating the chamber from the primary barrelhead without dismantling the at least one blast barrel from connected high pressure lines;

at least two sensors for monitoring fluid pressures in predetermined locations in the one or more blast choke barrels;

an automatically controlled blast choke in each blast barrel for adjusting the flow of fluids through the one or more blast choke barrels via a controller based on the monitored pressures from the at least two sensors;

a closed loop separation tank for accepting the fluid flow from the at least one blast barrel and for separating the fluid flow into a remaining solid material, produced water, produced oil, and gas.

13. The system of claim 12 wherein the automatically controlled blast choke for adjusting further comprises data from at least one level sensor for monitoring a level of the remaining solid material, produced water, and produced oil, and gas.

14. The system of claim 12 further comprising a diffuser for diffusing the fluid flow at an inlet to the separation tank.

15. The system of claim 14 wherein diffuser comprises a series of baffles and gravity separation structures.

16. The system of claim 12 wherein the predetermined locations for the at least two sensors comprise at least one first sensor upstream of a fluid choke and at least one second sensor downstream of the fluid choke.

17. The system of claim 12 further comprising a remote controller for receiving data from the at least two sensors and for transmitting commands to the automatically controlled blast choke.

18. The system of claim 12 wherein the separation tank comprises a centrifugal, gravitational, or filtration system.

19. The system of claim 12 wherein the automatically controlled blast choke is adjusted based on data from the at least two pressure sensors, flow sensors, choke position sensors, and a predetermined calculated flow rate.

20. The system of claim 12 wherein the automatically controlled blast choke comprises a choke configured for restricting the fluid flow, for reducing of flow pressure and for re-directing the fluid flow in a horizontal direction.

21. The system of claim 12 wherein the automatically controlled blast choke comprises a tapered pin for linearly moving in a forward and reverse direction towards and away from a choke insert.

22. The system of claim 12 further comprising the separation tank is configured to independently store the separated remaining solid material, produced water, produced oil, and gas.

* * * * *